US007959062B2

(12) United States Patent
Auclair

(10) Patent No.: US 7,959,062 B2
(45) Date of Patent: Jun. 14, 2011

(54) REINFORCED CARTON HANDLE STRUCTURE

(75) Inventor: Jean-Michel Auclair, Chateauroux (FR)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 428 days.

(21) Appl. No.: 12/064,230

(22) PCT Filed: Aug. 18, 2006

(86) PCT No.: PCT/US2006/032529

§ 371 (c)(1),
(2), (4) Date: Sep. 15, 2008

(87) PCT Pub. No.: WO2007/022482

PCT Pub. Date: Feb. 22, 2007

(65) Prior Publication Data

US 2009/0212095 A1 Aug. 27, 2009

(30) Foreign Application Priority Data

Aug. 19, 2005 (GB) ..... 0517101.2

(51) Int. Cl.
*B65D 5/46* (2006.01)

(52) U.S. Cl. ..... 229/117.17; 206/427; 229/117.16

(58) Field of Classification Search ..... 229/117.13, 229/117.14, 117.16, 117.17
See application file for complete search history.

(56) References Cited

U.S. PATENT DOCUMENTS

| | | | | | |
|---|---|---|---|---|---|
| 2,612,305 | A * | 9/1952 | Klasing et al. | ..... | 229/117.17 |
| 2,747,766 | A * | 5/1956 | Bergstein | ..... | 229/117.13 |
| 3,927,822 | A * | 12/1975 | Giebel | ..... | 229/117.17 |
| 4,140,267 | A * | 2/1979 | Scott et al. | ..... | 229/117.15 |
| 4,240,546 | A * | 12/1980 | Stone | ..... | 229/117.14 |
| 4,243,171 | A * | 1/1981 | Prin | ..... | 229/117.16 |
| 4,331,289 | A * | 5/1982 | Killy | ..... | 229/117.13 |
| 5,482,203 | A * | 1/1996 | Stout | ..... | 229/117.13 |
| 5,772,030 | A * | 6/1998 | Baxter | ..... | 229/117.13 |
| 5,779,049 | A * | 7/1998 | Werby et al. | ..... | 229/117.13 |
| 6,250,542 | B1 * | 6/2001 | Negelen | ..... | 229/117.16 |
| 6,848,573 | B2 * | 2/2005 | Gould et al. | ..... | 229/117.13 |
| 6,866,187 | B2 * | 3/2005 | Reagan et al. | ..... | 229/117.14 |
| 7,234,596 | B2 * | 6/2007 | Lebras | ..... | 229/117.17 |

* cited by examiner

*Primary Examiner* — Gary E Elkins
(74) *Attorney, Agent, or Firm* — MWV Intellectual Property Group

(57) ABSTRACT

A reinforced carton handle structure includes a carton wall panel (16) hinged along a first fold line (40) to a linear series of at least two reinforcing panels (26, 32, 34) hinged one to the next. Each of the carton wall panel (16) and reinforcing panels (26, 32, 34) includes an aperture or recess (54, 56) for forming a handle opening. One of the reinforcing panels (26) in the linear series is hinged to a next reinforcing panel (32) of the linear series about a second fold line (87*a*, 87*b*) that is closer to the first fold line (40) than an edge of the one reinforcing panel (26) which edge is furthest from the first fold line (40).

16 Claims, 4 Drawing Sheets

REINFORCED CARTON HANDLE STRUCTURE

FIELD OF INVENTION

The present invention relates to handle structures and more particularly, though not exclusively, to reinforced carton handle structures.

BACKGROUND OF THE INVENTION

An inherent technical challenge in the field of packaging design, is that of providing handle structures, by which the user may grasp the package, that are sufficiently strong to support the full weight of the articles contained therein, whilst not unduly adding to the production costs of the packaging.

U.S. Pat. No. 4,037,777 discloses a means by which material may be struck from portions of a composite top panel to act as reinforcement of a handle structure. Such a method of reinforcement requires the presence of a suitable composite top panel in the packaging and also serves to weaken the structural integrity of the composite top panel. Furthermore, this method allows only for the provision of a second layer of material to serve as reinforcement around the handle structure and cannot provide for a third and subsequent layers.

In many cases, the weight of the articles is such that one or two thicknesses of the packaging material may be insufficient to provide the necessary structural integrity for transporting the article. For example, WO 2004 002 837 discloses a carton wherein the only means by which reinforcement of the handle structures may be achieved is through the provision of dedicated reinforcement panels. However, should additional layers of reinforcement be desired, the invention of WO 2004 002 837 would require the amount of material required for the reinforcement panels to increase proportionately.

Both GB 2325459 and FR 8711249 illustrate, by way of technological background, reinforced handles applied to cartons.

The present invention seeks to overcome or at least mitigate the problems of the prior art. It is desirable to provide a reinforced carton handle structure that may provide additional layers of reinforcement around the handle edges, without requiring a proportional increase in material for the reinforcing panels.

SUMMARY

A first aspect of the present invention provides a reinforced carton handle structure comprising a carton wall panel hinged to a linear series of at least two reinforcing panels hinged one to the next. Each of the carton wall panel and reinforcing panels comprise some portion of an aperture. At least one reinforcing panel in the linear series is hinged to a next reinforcing panel of the linear series about a fold line that is closer to the carton wall panel than an edge of the at least one reinforcing panel that is furthest from the carton wall panel.

A second aspect of the present invention provides a reinforced carton handle structure wherein the at least one reinforcing panel is hinged upon each side to first reinforcing flaps and the next reinforcing panel is hinged upon each side to second reinforcing flaps, and wherein each of the first reinforcing flaps are hinged to those second reinforcing flaps located on the same side of the linear series of reinforcing panels. The fold line about which the reinforcing flaps are hinged, is closer to the carton wall panel than the edge of the preceding reinforcing panel that is furthest from the carton wall panel.

Preferably, wherein at least one reinforcing panel is hinged to the next reinforcing panel as a result of the first reinforcing flaps being hinged to the second reinforcing flaps.

Preferably, wherein the linear series comprises three reinforcing panels resulting in a 4-ply thickness of material in the reinforced carton handle structure.

Preferably, wherein the reinforcing panels comprise apertures and recesses that are in registry with the hand aperture defined within the carton wall panel, when the reinforced carton handle structure is set up.

In one embodiment of the present invention, a reinforced carton handle structure is provided at both ends of a carton formed from two blanks wherein a tray portion including the reinforced carton handle structures is formed from a first blank and a cover portion is formed from a second blank.

A further aspect of the invention provides a blank for forming a reinforced carton handle structure comprising a wall panel hinged to a linear series of at least two reinforcing panels hinged one to the next. At least one reinforcing panel in the linear series is hinged to a next reinforcing panel of the linear series about a fold line that is closer to the carton wall panel than an edge of the at least one reinforcing panel that is furthest from the carton wall panel.

Preferably, wherein at least one reinforcing panel of the blank is hinged upon each side to first reinforcing flaps and the next reinforcing panel is hinged upon each side to second reinforcing flaps, and wherein each of the first reinforcing flaps are hinged to those second reinforcing flaps located on the same side of the linear series of reinforcing panels, and wherein the fold line about which the reinforcing flaps are hinged, is closer to the carton wall panel than the edge of the at least one reinforcing panel that is furthest from the carton wall panel.

A further embodiment of the present invention being that of a reinforced carton handle structure comprising a carton wall hinged to a linear series of three reinforcing panels hinged one to the next. A first reinforcing panel of the linear series and a second reinforcing panel in the linear series are each hinged upon both sides to corresponding reinforcing flaps, and wherein a reinforcing flap hinged to one side of the second reinforcing panel is hinged, about a fold line offset from the proximal edge of the first reinforcing panel of the linear series, to the reinforcing flap that is hinged to the corresponding side of said first reinforcing panel.

Preferably wherein the above reinforced carton handle structure is provided at both ends of a carton formed from two blanks wherein a tray portion including the reinforced carton handle structures is formed from the first blank and a cover portion is formed from the second blank.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
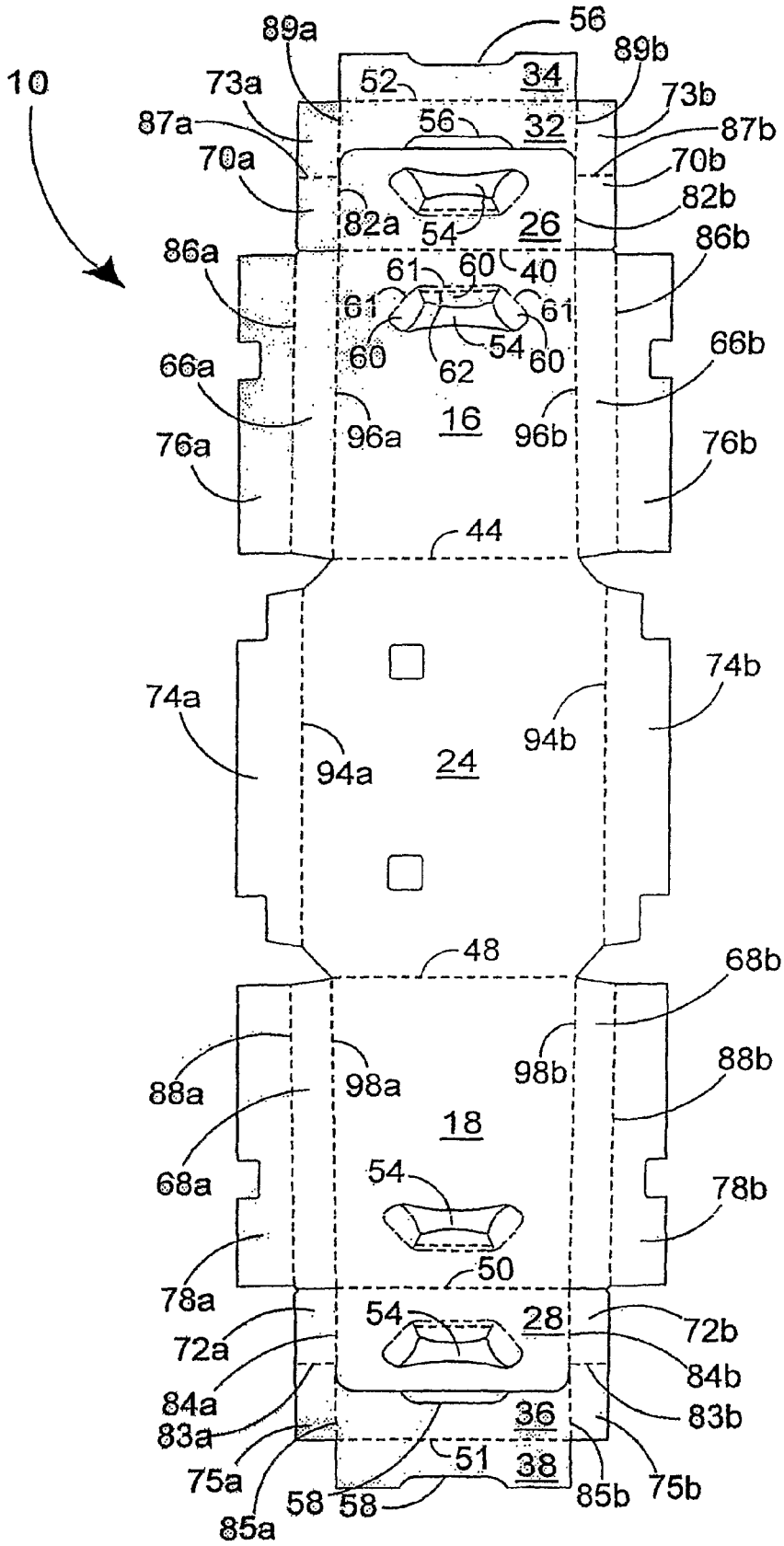
FIG. 1 illustrates a plan view of a blank for forming a carton that includes a reinforced carton handle structure according to a preferred embodiment of the of the present invention.

The present invention relates to a reinforced carton handle structure. FIG. 1 shows a carton blank incorporating a reinforced handle structure according to a preferred embodiment of the present invention. Carton blank 10 includes a base panel 24, to opposing ends of which, are hinged end wall panels 16 and 18 by fold lines 44 and 48 respectively. Side flaps 74*a* and 74*b* are hinged to opposing sides of the base panel 24 by fold lines 94*a* and 94*b* respectively.

Bevel panels 66*a* and 66*b* are hinged, on opposing sides, to end wall panel 16 about is fold lines 96*a* and 96*b* respectively. Each bevel panel 66*a* and 66*b* is then hinged, in turn, to a side support panel 76*a* and 76*b* about respective fold lines 86*a* and 86*b*.

A reinforcing structure is provided, comprising, in this embodiment, a first reinforcing panel 26 hinged to an edge of the end wall panel 16 furthest from the base panel 24, about fold line 40.

Defined within end wall panel 16 is hand aperture 54 defined within which are a number of finger flaps 60 each of which being hinged to end wall panel 16 by a respective one of fold lines 61.

First reinforcing flaps 70*a* and 70*b* are hinged, about fold line 82*a* and 82*b*, to opposing sides of first reinforcing panel 26. Fold lines 87*a* and 87*b* each define an edge of each respective first reinforcing flap 70*a* and 70*b*, fold lines 87*a* and 87*b* are adjacent fold lines 82*a* and 82*b* respectively.

Second reinforcing flaps 73*a* and 73*b* are hinged to the first reinforcing flaps 70*a* and 70*b*, about the fold lines 87*a* and 87*b* respectively. Second reinforcing flaps 73*a* and 73*b* are hinged, about fold lines 89*a* and 89*b*, to opposing sides of a second reinforcing panel 32.

First reinforcing panel 26 and second reinforcing panel 32 are in effect hinged to one another via first reinforcing flaps 70*a* and 70*b* and second reinforcing flaps 73*a* and 73*b*.

In the embodiment illustrated in FIG. 1, second reinforcing panel 32 is disposed between the first reinforcing panel 26 and a third reinforcing panel 34.

The third reinforcing panel 34 is hinged to an edge of the second reinforcing panel 32 that is furthest from the base panel 24, by 52.

Preferably, a recess 56 is provided in the free edges of the second and third reinforcing panel 56.

FIGS. 1 to 4 illustrate a reinforced carton handle structure, according to a preferred embodiment of the present invention, the preferred embodiment being a tray for a two part carton. The blank of FIGS. 1 to 4 is symmetrical about the transverse axis and therefore details of the features of the opposite end of the blank are summarised as follows.

Bevel panels 68*a* and 68*b* are hinged, on opposing sides, to end wall panel 18 about fold lines 98*a* and 98*b* respectively. Each bevel panel 68*a* and 68*b* is then hinged, in turn, to a side support panel 78*a* and 78*b* about respective fold lines 88*a* and 88*b*.

First reinforcing panel 28 is hinged to an edge of the end wall panel 18 furthest from the base panel 24, about fold line 50.

Defined within end wall panel 18 is hand aperture 54 defined within which are a number of finger flaps 60 each of which being hinged to end wall panel 18 by a respective one of fold lines 61.

First reinforcing flaps 72*a* and 72*b* are hinged, about fold line 84*a* and 84*b*, to opposing sides of first reinforcing panel 28. Fold lines 83*a* and 83*b* each define an edge of each respective first reinforcing flap 72*a* and 72*b*, fold lines 83*a* and 83*b* are adjacent fold lines 84*a* and 84*b* respectively.

Second reinforcing flaps 75*a* and 75*b* are hinged to the first reinforcing flaps 70*a* and 70*b*, about the fold lines 83*a* and 83*b* respectively. Second reinforcing flaps 75*a* and 75*b* are hinged, about fold lines 85*a* and 85*b*, to opposing sides of a second reinforcing panel 36.

First reinforcing panel 28 and second reinforcing panel 36 are in effect hinged to one another via first reinforcing flaps 72*a* and 72*b* and second reinforcing flaps 75*a* and 75*b*.

Second reinforcing panel 36 is disposed between the first reinforcing panel 28 and a third reinforcing panel 38.

The third reinforcing panel 38 is hinged to an edge of the second reinforcing panel 36 that is furthest from the base panel 24, by 51.

Each of panels 16, 26, 18 and 28 have defined within them, hand apertures 54 and finger flaps 60. Each finger flap 60 is hinged to a respective one of panels 16,18, 26 or 28 by a respective one of fold lines 61. The larger of the finger flaps 60 within each of panels 16, 18, 26 and 28 have defined with them, a further fold line 62 parallel and offset from fold line 61.

Likewise, recesses 58 are provided in the second and third reinforcing panels 36, 38.

Figure 2:
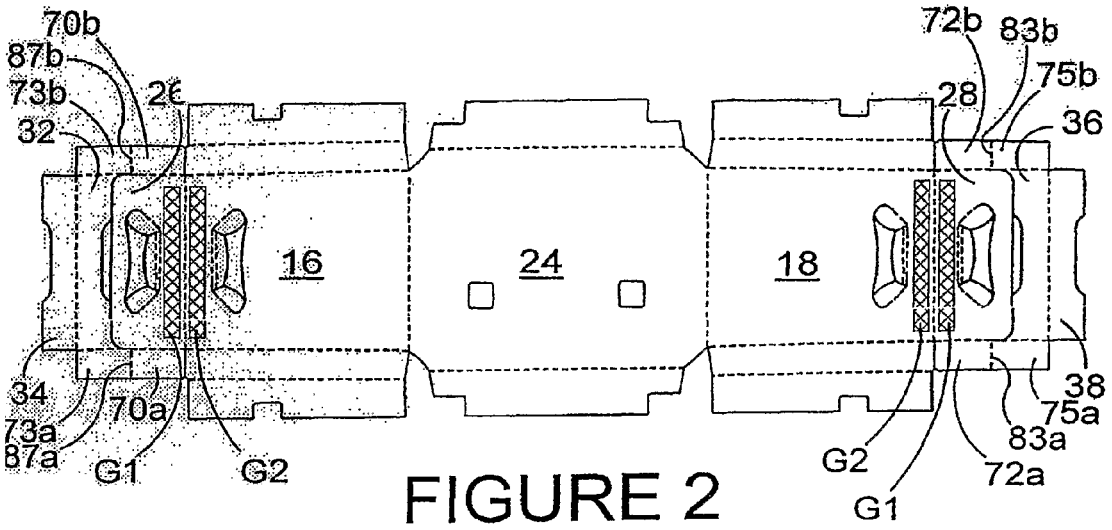
FIG. 2 illustrates the locations on the blank of FIG. 1 at which glue should be applied.
Figure 3:
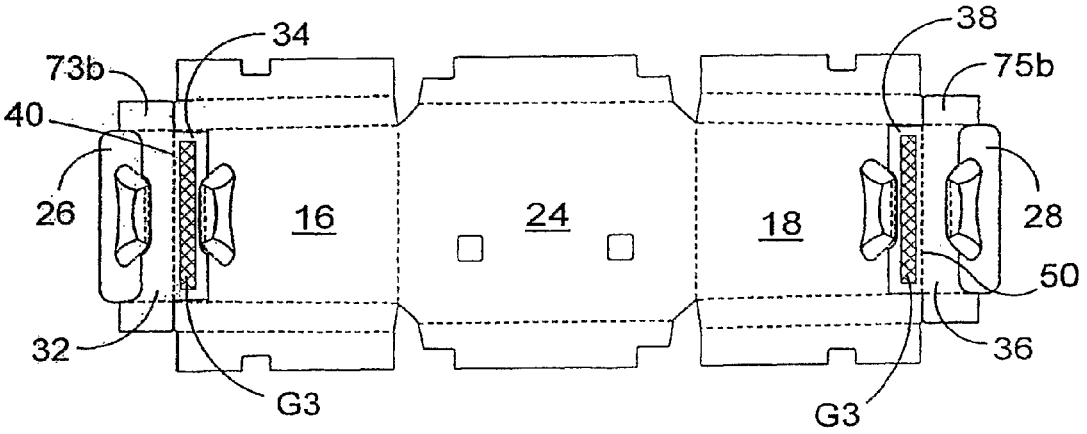
FIG. 3 illustrates the blank of FIG. 1, at the first stage in the folding process.
Figure 4:
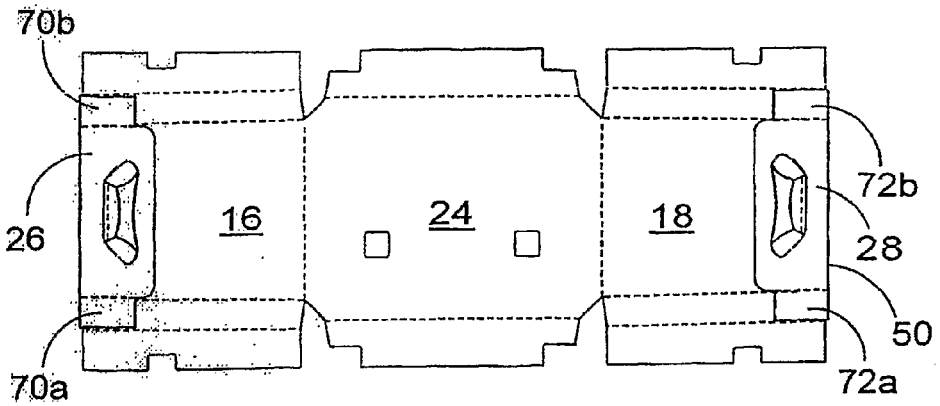
FIG. 4 illustrates the blank of FIG. 1, at the second stage in the folding process.

Turning now to the process by which the reinforced carton handle structure is set up, FIGS. 2 to 4 illustrate a sequence by which the preferred embodiment of the present invention may be partially set up. FIG. 2 illustrates the areas, G1 and G2, to which glue is initially applied. Of course, it is envisaged that other means of securing panels together can be employed without departing from the scope of the invention.

Second reinforcing flaps 73*a*/75*a* and 73*b*/75*b* are then folded, about fold lines 87*a*/83*a* and 87*b*/83*b*, so as to bring the uppermost surface of second reinforcing panel 32/36 and third reinforcing panel 34/38 into face contacting relation with G1 and G2 respectively.

FIG. 3 illustrates the reinforced carton handle structure in a partially set up state. Glue point G3 is illustrated as being located upon the upper-most surface of third reinforcing panel 34/38. FIG. 3 also illustrates the way in which third reinforcing panel 34/38 has a shaped edge (or recess) 56/58 such that it is in registry with the edge of the hand aperture 54 defined within end wall panel 16/18 and first reinforcing panel 26/28.

FIG. 4 shows the reinforced carton handle structure in fully set up condition resulting from the folding of the first reinforcing panel 26/28 about fold line 40/50 such that third reinforcing panel 34/38 comes into substantially face contacting relationship with end wall panel 16/18 at glue point G3. Also illustrated is the fact that hand aperture 54, defined within first reinforcing panel 26/28 is positioned such that it is in registry with hand aperture 54 defined within end wall panel 16/18 when the first reinforcing panel is folded about fold line 40/50.

Figure 5:
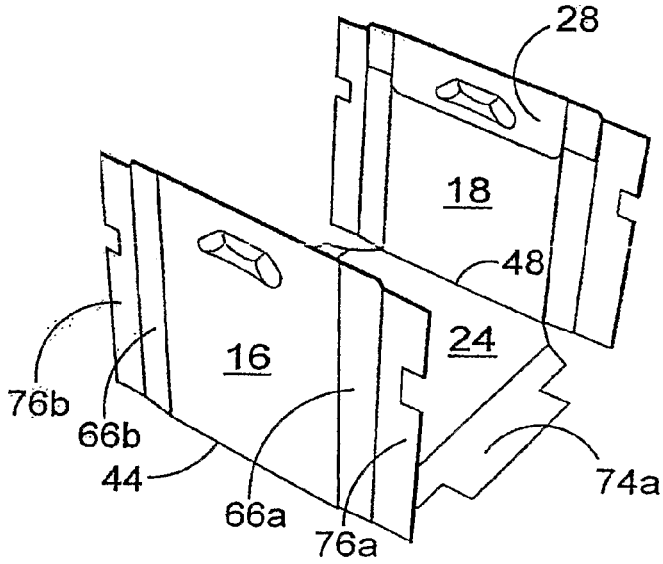
FIG. 5 illustrates the partially set up tray component of a carton that includes a reinforced carton handle structure according to a preferred embodiment of the of the present invention.
Figure 6:
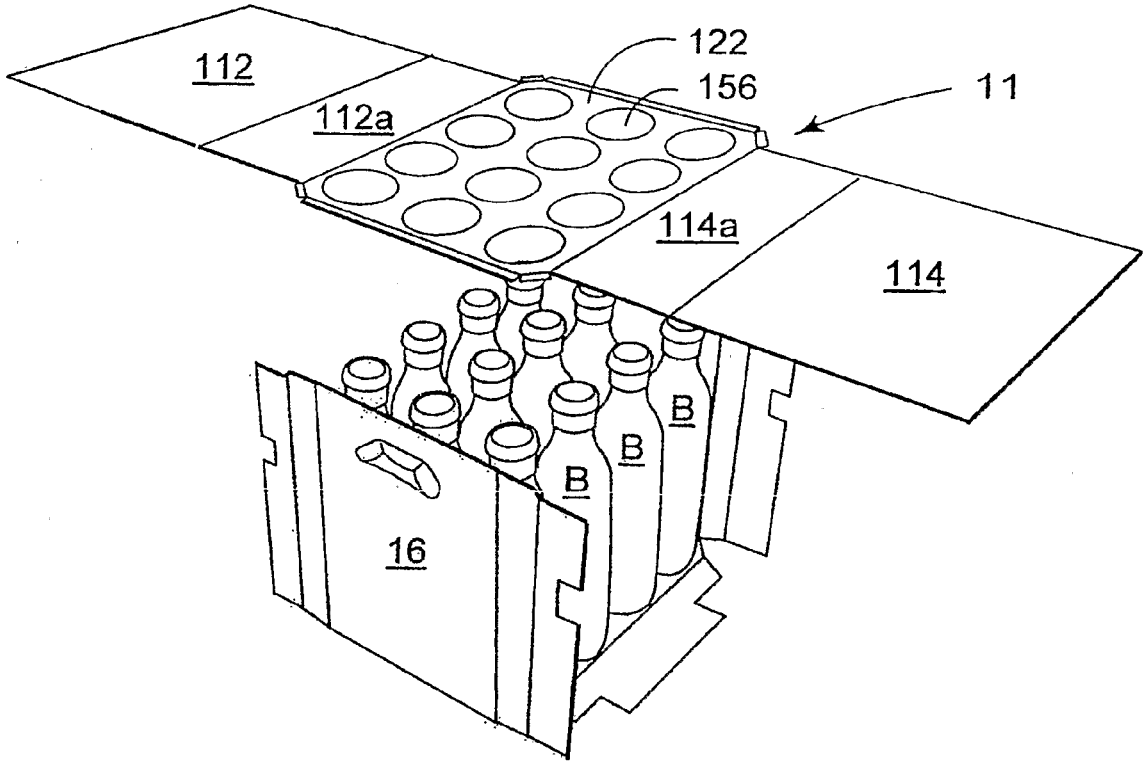
FIG. 6 illustrates the partially set up tray component of FIG. 5 with the partially set up cover component of a carton that includes the reinforced carton handle structure according to a preferred embodiment of the of the present invention.
Figure 7:
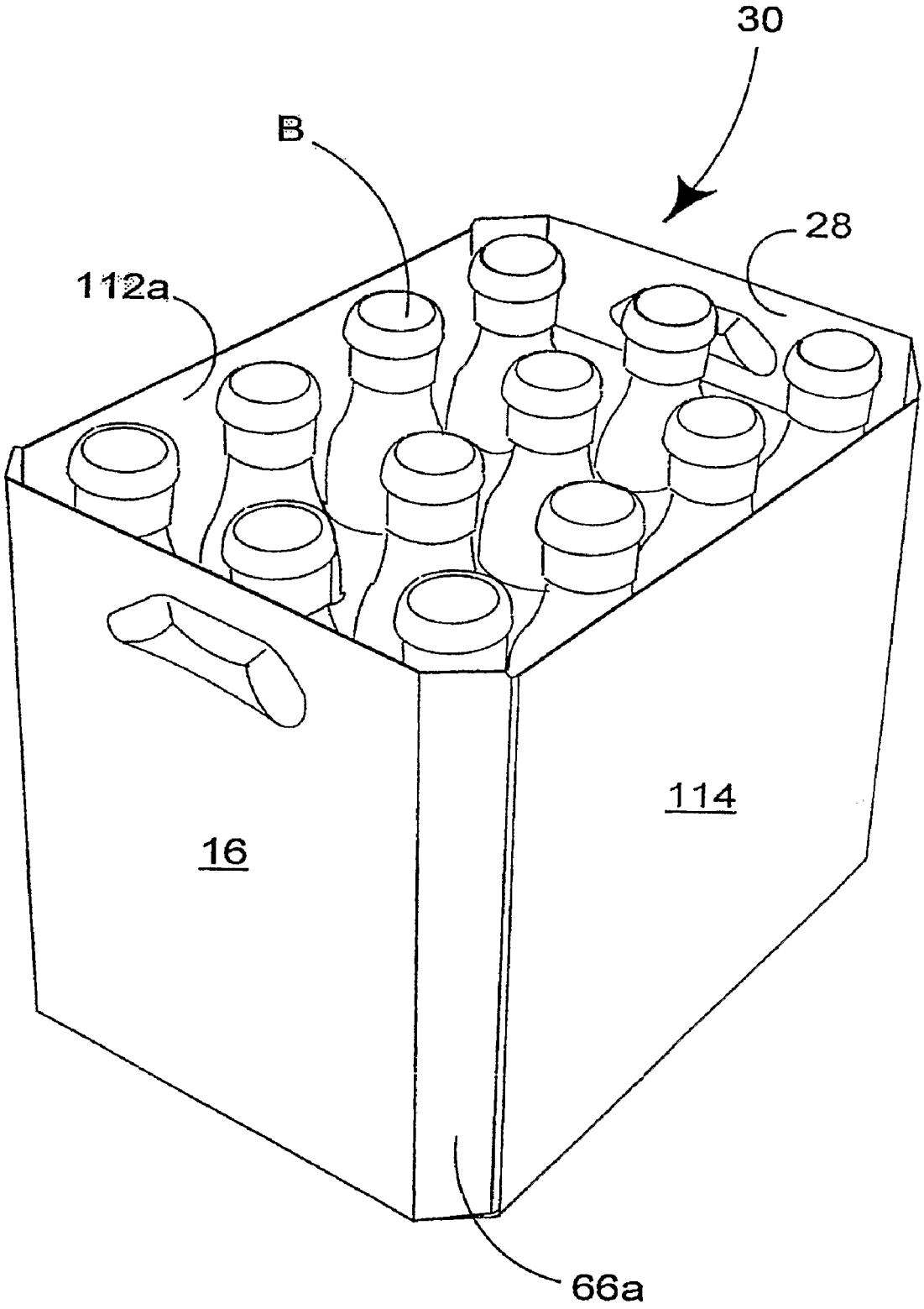
FIG. 7 illustrates a set up carton that includes the reinforced carton handle structure according to a preferred embodiment of the present invention.

FIGS. 5 to 7 illustrate the steps of setting up a carton according to a preferred embodiment of the present invention. FIG. 5 shows the use of the reinforced carton handle structure according to a preferred embodiment of the present invention in the end wall panels 16 and 18 of a carton tray structure. The end wall panels 16 and 18 have been folded at right angles to the base panel 24, about fold lines 44 and 48 respectively.

FIG. 6 shows one possible cover portion 11 that it is envisaged may be applied to a tray structure of FIG. 5.

FIG. 7 shows the set up carton of FIGS. 5 and 6. Bevel panels 66*a*, 66*b*, 68*a* and 68*b* have been folded out of the planes of end wall panels 16 and 18 about fold lines 96*a*, 96*b*, 98*a* and 98*b* respectively. Side support panels 76*a*, 76*b*, 78*a* and 78*b* have been folded about fold lines 86*a*, 86*b*, 88*a* and 88*b* respectively. Side flaps 74*a* and 74*b* have been folded at right angles to the base panel 24, about fold lines 94*a* and 94*b*. Beam panels 114*a* and 112*a* of the cover 11 have been folded upwards at right angles to the top panel 122 and the side wall panels 112 and 114 have been folded such that they are in substantially face contacting relationship with beam panels 112*a* and 114*a*. Side wall panels 112 and 114 are then attached to side support panel 76*a*, 76*b*, 78*a* and 78*b* as well as side flaps 74*a* and 74*b*.

FIG. 7 illustrates the structure of the present invention is not unduly visible in the set up carton and therefore does not detract from the aesthetic appeal of the product.

Referring to FIGS. 1 and 7; in use, the user pushes his hands through the hand apertures 54, causing the finger flaps 60 to be struck from the hand apertures 54, interior of the package about fold lines 61. Fold line 62 defined with the largest finger flap 60, within each hand aperture, allows the finger flap to fold around the thickness of the reinforced handle structure and into substantially face contacting relationship with the interior face of the first reinforcing panel.

It is envisaged that the features of the various embodiments herein described could be altered without departing from the scope of the present invention. For example the reinforced carton handle structure may be applied to cartons of different designs such as top gripping, wrap around, tray, end or top loading. Also, the sizing and orientation of the handle structure may well be altered to suit the specific carton design in which it is embodied, and may well be located other than in opposing end walls.

It will be recognised that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a score line, a frangible line or a fold line without departing from the scope of the invention.

The invention claimed is:

1. A reinforced carton handle structure comprising a carton wall panel hingedly connected along a first fold line to a linear series of at least two reinforcing panels hingedly connected one to the next, wherein each of the carton wall panel and reinforcing panels comprises a handle-forming region for forming a handle opening, the handle-forming regions of the carton wall panel and reinforcing panels being in registry with one another to provide said handle opening wherein one of the reinforcing panels in the linear series is hingedly connected along the first fold line to the carton wall panel and along a pair of spaced second fold lines to a next reinforcing panel of the linear series, said one reinforcing panel being defined in part by a free edge thereof spanning a space between the second fold lines, the second fold lines being closer to the first fold line than the free edge of said one reinforcing panel, wherein said one reinforcing panel is hingedly connected at opposed side edges thereof to first reinforcing flaps, said next reinforcing panel is hingedly connected at opposed side edges thereof to second reinforcing flaps, said first reinforcing flaps are hingedly connected to said second reinforcing flaps along said second fold lines respectively.

2. The reinforced carton handle structure as claimed in claim 1 wherein the said one reinforcing panel is hingedly connected to the said next reinforcing panel through said first and second reinforcing flaps.

3. The reinforced carton handle structure as claimed in claim 1 wherein the linear series comprises three reinforcing panels hingedly connected one to the next, said carton wall panel and three reinforcing panels together providing a four-ply thickness area between said first fold line and said handle opening.

4. The reinforced carton handle structure as claimed in claim 1 wherein each of the handle-forming regions of the carton wall panel and reinforcing panels comprises an aperture or recess.

5. The reinforced carton handle structure as claimed in claim 1 wherein the handle-forming region of the carton wall panel comprises a first hand aperture and a first handle area extending between the first hand aperture and the first fold line, and wherein the second fold lines are disposed on opposite sides of the first hand aperture at positions spaced apart from the first hand aperture.

6. The reinforced carton handle structure as claimed in claim 5 wherein the handle-reinforcing region of the one reinforcing panel comprises a second hand aperture and a second handle area, said first handle area being disposed in registry with said second handle area.

7. The reinforced carton handle structure as claimed in claim 6 wherein the handle-forming region of the next reinforcing panel comprises a first recess that is disposed in substantial registry with the first and second hand apertures.

8. The reinforced carton handle structure as claimed in claim 7 wherein the linear series comprises a third reinforcing panel hingedly connected the next reinforcing panel along a third fold line, the next reinforcing panel further comprising a third handle area extending between the first recess and the third fold line, the third handle area being disposed in registry with the first and second handle areas.

9. The reinforced carton handle structure as claimed in claim 8 wherein the third reinforcing panel comprises a second recess and a fourth handle area, the second recess being disposed in registry with the first recess, the fourth handle area being in registry with the first, second and third handle areas.

10. A carton comprising a plurality of carton wall panels including a first wall panel, the first wall panel being hingedly connected along a first fold line to a first linear series of at least two reinforcing panels hingedly connected one to the next, wherein each of the first wall panel and reinforcing panels comprises a handle-forming region for forming a first handle opening, the handle-forming regions of the first wall panel and reinforcing panels being in registry with one another to provide said handle opening wherein one of the reinforcing panels in the linear series is hingedly connected along the first fold line to the first wall panel and along a pair of spaced second fold lines to a next reinforcing panel of the linear series, said one reinforcing panel being defined in part by a free edge thereof spanning a space between the second fold lines, the second fold lines being closer to the first fold line than said free edge of said one reinforcing panel, wherein said one reinforcing panel is hingedly connected at opposed side edges thereof to first reinforcing flaps, said next reinforcing panel is hingedly connected at opposed side edges thereof to second reinforcing flaps, said first reinforcing flaps are hingedly connected to said second reinforcing flaps along said second fold lines, respectively.

11. The carton as claimed in claim 10 further comprising a pair of mutually secured tray and cover portions formed from two separate blanks respectively, the tray portion including the first wall panel and the reinforcing panels.

12. The carton according to claim 11 wherein the tray portion includes a second wall panel connected along a third fold line to a second linear series of at least two reinforcing panels hingedly connected one to the next, wherein each of the second wall panel and the reinforcing panels of the second linear series comprises a handle-forming region for forming a second handle opening, the handle-forming region of the second wall panel and the handle-forming regions of the reinforcing panels of the second linear series being in registry with one another to provide said second handle opening wherein one of the reinforcing panels in the second linear series is hingedly connected along the third fold line to the second wall panel and along a pair of spaced fourth fold lines to a next reinforcing panel of the second linear series, said one reinforcing panel in the second linear series being defined in part by a free edge thereof spanning a space between the fourth fold lines, the fourth fold lines being closer to the third fold line than said free edge of said one reinforcing panel of the second linear series.

13. A blank for forming a carton having a reinforced carton handle structure comprising a carton wall panel hingedly connected along a first fold line to a linear series of at least two reinforcing panels hingedly connected one to the next, wherein each of the carton wall panel and reinforcing panels comprises a handle-forming region for forming a handle opening, the handle-forming regions of the carton wall panel and reinforcing panels being in registry with one another to provide said handle opening when said blank is set up into a carton, wherein one of the reinforcing panels in the linear series is hingedly connected along the first fold line to the carton wall panel and along a pair of spaced second fold lines to a next reinforcing panel of the linear series, said one reinforcing panel being defined in part by a free edge thereof spanning a space between the second fold lines, the free edge further defining part of the next reinforcing panel of the linear series, the second fold lines being closer to the first fold line than the free edge of said one reinforcing panel, wherein said one reinforcing panel is hingedly connected at opposed side edges thereof to first reinforcing flaps, said next reinforcing panel is hingedly connected at opposed side edges thereof to second reinforcing flaps, said first reinforcing flaps are hingedly connected along said second fold lines to the second reinforcing flaps respectively.

14. The blank as claimed in claim 13 wherein the said one reinforcing panel is hinged to said next reinforcing panel as a result of said first reinforcing flaps being hinged to said second reinforcing flaps.

15. The blank as claimed in claim 13 wherein the linear series comprises three reinforcing panels hingedly connected one to the next, said carton wall panel and said three reinforcing panels resulting in providing in a set up condition said reinforced handle structure of a four-ply thickness of material.

16. The blank as claimed in claim 13 wherein the handle-forming region of each of the carton wall panel and reinforcing panels comprises an aperture or recess.

* * * * *